US005897716A

United States Patent [19]

Reghi et al.

[11] Patent Number: 5,897,716

[45] Date of Patent: Apr. 27, 1999

[54] COMPOSITION AND PROCESS FOR TREATING METAL

[75] Inventors: Gary Reghi, Rochester Hills; Karl Korinek, Troy, both of Mich.

[73] Assignee: Henkel Corporation, Plymouth Meeting, Pa.

[21] Appl. No.: 08/649,700

[22] PCT Filed: Nov. 23, 1994

[86] PCT No.: PCT/US94/13273

§ 371 Date: May 30, 1996

§ 102(e) Date: May 30, 1996

[87] PCT Pub. No.: WO95/14539

PCT Pub. Date: Jun. 1, 1995

Related U.S. Application Data

[63] Continuation-in-part of application No. 08/158,667, Nov. 29, 1993, abandoned.

[51] Int. Cl.[6] ..... C23C 22/00

[52] U.S. Cl. ..... 148/247; 146/267

[58] Field of Search ..... 148/247, 267, 148/266, 250; 252/390, 307, 350; 524/320

[56] References Cited

U.S. PATENT DOCUMENTS

| | | | |
|---|---|---|---|
| 4,136,073 | 1/1979 | Muro | 148/247 |
| 4,273,592 | 6/1981 | Kelly | 148/6.27 |
| 4,313,769 | 2/1982 | Frelin et al. | 148/6.27 |
| 4,370,177 | 1/1983 | Frelin et al. | 148/6.27 |
| 4,963,596 | 10/1990 | Lindert et al. | 526/313 |
| 5,089,064 | 2/1992 | Reghi | 148/247 |
| 5,342,456 | 8/1994 | Dolan | 148/247 |

FOREIGN PATENT DOCUMENTS

| | | |
|---|---|---|
| 2487381 | 1/1982 | France . |
| 8505131 | 11/1985 | WIPO . |
| 9320260 | 10/1993 | WIPO . |

*Primary Examiner*—Scott Kastler

*Attorney, Agent, or Firm*—Wayne C. Jaeschke; Norvell E. Wisdom, Jr.; Wayne C. Jaeschke, Jr.

[57] ABSTRACT

A chemically and thermally stable chromate free aqueous liquid treatment for metals, especially aluminum, that imparts corrosion resistance as good as that from conventional chromate containing treatments, contains water and:

(A) a component selected from the group consisting of $H_2TiF_6$, $H_2ZrF_6$, $H_2HfF_6$, $H_2SiF_6$, $H_2GeF_6$, $H_2SnF_6$, $HBF_4$, and mixtures thereof; and (B) a component selected from the group consisting of water soluble organic carboxylic acids that contain at least two hydroxyl groups, exclusive of the hydroxyl groups that are part of any carboxyl groups, per carboxyl group in each acid molecule, the water soluble salts of such acids, and mixtures of any two or more of these acids and salts; and, optionally, one or more of the following:

(C) a component selected from the group consisting of Ti, Zr, Hf, Al, Si, Ge, Sn, and B, the oxides, hydroxides, and carbonates of Ti, Zr, Hf, Al, Si, Ge, Sn, and B, and mixtures of any two or more of these elements, oxides, hydroxides, and carbonates;

(D) a component selected from the group consisting of water soluble and water dispersible polymers and copolymers of one or more x-(N—$R^1$—N—$R^2$-aminomethyl)-4-hydroxy-styrenes, where x=2, 4, 5, or 6, $R^1$ represents an alkyl group containing from 1 to 4 carbon atoms, and $R^2$ represents a substituent group conforming to the general formula $H(CHOH)_nCH_2$-, where n is an integer from 1 to 7;

(E) a pH adjusting component selected from the group consisting of inorganic acids and inorganic alkaline materials that do not contain fluorine;

(F) a component selected from the group consisting of inorganic acids that contain fluorine but do not contain any of the elements Ti, Zr, Hf, Al, Si, Ge, Sn, and B; and (G) a foam reducing amount of an antifoam agent component.

20 Claims, No Drawings

COMPOSITION AND PROCESS FOR TREATING METAL

CROSS-REFERENCE TO RELATED APPLICATION

This application is a continuation-in-part of application Ser. No. 08/158,667 filed Nov. 29, 1993, now abandoned.

BACKGROUND OF THE INVENTION

1. Field of the Invention

This invention relates to processes of treating metal surfaces with aqueous acidic compositions to increase the resistance to corrosion of the treated metal surface, either as thus treated or after subsequent overcoating with some conventional organic based protective layer, and to increase the adhesion of such a protective layer.

2. Statement of Related Art

A very wide variety of materials have been taught in the prior art for the general purposes of the present invention, but most of them contain hexavalent chromium or other inorganic oxidizing agents which are environmentally undesirable.

DESCRIPTION OF THE INVENTION

Objects of the Invention

A major object of the invention is to provide a storage stable treatment composition and process that can be substantially free from hexavalent chromium but can protect metals substantially as well as the hexavalent chromium containing treatments of the prior art. Other alternative or concurrent objects are to provide faster processing speed, better protection against corrosion, more economical operation, improved stability of the treatment compositions, and less adverse environmental impact.

General Principles of Description

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred. Also, unless expressly stated to the contrary: percent, "parts of", and ratio values are by weight; the term "polymer" includes "oligomer", "copolymer", "terpolymer", and the like; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description, and does not necessarily preclude chemical interactions among the constituents of a mixture once mixed; specification of materials in ionic form implies the presence of sufficient counterions to produce electrical neutrality for the composition as a whole (any counterions thus implicitly specified should preferably be selected from among other constituents explicitly specified in ionic form, to the extent possible; otherwise such counterions may be freely selected, except for avoiding counterions that act adversely to the objects of the invention); and the term "mole" and its variations may be applied to elemental, ionic, and any other chemical species defined by number and type of atoms present, as well as to compounds with well defined molecules.

SUMMARY OF THE INVENTION

It has been found that the objects of the invention can be achieved by acidic aqueous compositions comprising, preferably consisting essentially of, or more preferably consisting of water and:

(A) a component selected from the group consisting of $H_2TiF_6$, $H_2ZrF_6$, $H_2HfF_6$, $H_2SiF_6$, $H_3AlF_6$, $H_2GeF_6$, $H_2SnF_6$, $HBF_4$, and mixtures thereof; and (B) a component selected from the group consisting of water soluble organic carboxylic acids that contain at least two hydroxyl groups, exclusive of the hydroxyl groups that are part of any carboxyl groups, per carboxyl group in each acid molecule and the water soluble salts of such acids; and, optionally, one or more of the following:

(C) a component selected from the group consisting of the elements Ti, Zr, Hf, Al, Si, Ge, Sn, and B and the oxides, hydroxides, and carbonates of all of these elements;

(D) a component selected from the group consisting of (i) tannic acids and (ii) water soluble and water dispersible polymers and copolymers of one or more x-(N—$R^1$—N—$R^2$-aminomethyl)-4-hydroxy-styrenes, where x=2, 4, 5, or 6, $R^1$ represents an alkyl group containing from 1 to 4 carbon atoms, preferably a methyl group, and $R^2$ represents a substituent group conforming to the general formula $H(CHOH)_nCH_2$-, where n is an integer from 1 to 7, preferably from 3 to 5;

(E) a pH adjusting component selected from the group consisting of inorganic acids and inorganic alkaline materials that do not contain fluorine;

(F) a component selected from the group consisting of inorganic acids that contain fluorine, but do not contain any of the elements Ti, Zr, Hf, Al, Si, Ge, Sn, and B, and the salts of all such acids; and (G) a foam reducing amount of an antifoam agent component.

In addition to the compositions described above, other embodiments of the invention include processes of treating metals with such compositions, articles of manufacture incorporating a coating formed by such a process, and concentrate compositions that are useful for making up working compositions according to the invention by dilution with water and/or for replenishing consumed ingredients in a working composition according to the invention that has been used to treat so much metal surface that its beneficial properties have been significantly diminished.

The compositions, after adjustment if necessary to appropriate concentration ranges of the active ingredients, are suitable for treating metal surfaces to achieve excellent resistance to corrosion, particularly after subsequent conventional coating with an organic binder containing protective coating. The compositions are particularly useful on iron and steel, galvanized iron and steel, zinc and those of its alloys that contain at least 50 atomic percent zinc, and, most preferably, aluminum and its alloys that contain at least 50, or still more preferably at least 90, atomic percent of aluminum. Treating normally begins by contacting the metal with the composition for a sufficient time to produce an improvement in the resistance of the surface to corrosion, and subsequently rinsing before drying. Such contact may be achieved by spraying, immersion, and the like as known per se in the art. It is optional, and often advantageous, after contacting the metal with a composition containing components (A) and (B) as described above, removing the metal from contact with this composition containing components (A) and (B) as described above, and rinsing with water, but before drying, to contact the metal surface with an aqueous composition comprising polymers and copolymers of one or more x-(N—$R^1$—N—$R^2$-aminomethyl)-4-hydroxystyrenes, where x=2, 4, 5, or 6, $R^1$ represents an alkyl group containing from 1 to 4 carbon atoms, preferably a methyl group, and $R^2$ represents a substituent group conforming to the general formula $H(CHOH)_nCH_2$-, where n is an integer from 1 to 7, preferably from 3 to 5. After such contact with a polymer containing aqueous composition, the surface may optionally be rinsed again with water before drying.

DESCRIPTION OF PREFERRED EMBODIMENTS

To the extent that their water solubility is sufficient, the fluoroacid component (A) may be freely selected from the group consisting of $H_2TiF_6$, $H_2ZrF_6$, $H_2HfF_6$, $H_3AlF_6$, $H_2SiF_6$, $H_2GeF_6$, $H_2SnF_6$, and $HBF_4$. $H_2TiF_6$, $H_2ZrF_6$, $H_2HfF_6$, $H_2SiF_6$, and $HBF_4$ are preferred; $H_2TiF_6$, $H_2ZrF_6$, and $H_2SiF_6$ are more preferred; and at least some $H_2TiF_6$ is most preferred. The total concentration of fluoroacid component in a working composition, i.e., one used for the actual treatment of metal surfaces, preferably is, with increasing preference in the order given, at least 0.5, 1.0, 1.5, 2.0, 3.0, 4.0, 4.5, 5.0, 5.3, 5.6, 5.8, 5.9, 6.0, 6.1, 6.2, 6.3, 6.4, or 6.5 and independently preferably is, with increasing preference in the order given, not more than 100, 50, 40, 30, 20, 15, 10, 9.0, 8.0, 7.6, 7.3, 7.1, 6.9, 6.8, 6.7, or 6.6 millimoles per liter (hereinafter "mM").

Preferably, the acids in component (B) are monobasic acids with from three to twelve, more preferably from four to eight, still more preferably from five to seven carbon atoms. Independently, the acids in this component preferably have one hydroxyl group attached to each carbon atom that is not part of a carboxyl group. The most preferred material for this component is gluconic acid. Independently of the chemical composition of component (B) within the limitations already stated for this component, the ratio of the total molar concentration of component (B) to the total molar concentration of the element Ti in compositions according to the invention preferably is, with increasing preference in the order given, at least 0.04:1.0, 0.11:1.0, 0.15:1.0, 0.19:1.0, 0.23:1.0, 0.26:1.0, 0.29:1.0, 0.31:1.0, 0.33:1.0, 0.34:1.0, or 0.35:1.0 and independently preferably is, with increasing preference in the order given, not more than 1.2:1.0, 1.0:1.0, 0.8:1.0, 0.6:1.0, 0.5:1.0, 0.45:1.0, 0.40:1.0, 0.39:1.0, 0.38:1.0, 0.37:1.0, or 0.36:1.0.

In processes in which treatment compositions that would be according to the invention, except for lacking component (B) as described above, are maintained at temperatures above 35° C. for extended periods of time and are repeatedly contacted with aluminum surfaces, as would occur, e.g., when treating aluminum substrates by spraying with the treatment composition, subsequently rinsing the surface thus treated, and recycling the drained treatment composition, it has been found that loss of titanium content of the compositions often occurs at a greater rate, sometimes a much greater rate, than can be accounted for by the amount of titanium incorporated into the coating formed by the treatment. (Presumably, this loss is due to formation of a precipitate in the treatment composition or formation of scale on the surface of containers or pipework in contact with the treatment composition.) Also, when heated above about 74° C., a treating composition containing components as noted above according to the invention, except for lacking component (B), can suffer thermal instability. Both of these undesired effects can be substantially reduced or practically eliminated by including appropriate amounts of component (B) as defined above in the compositions.

Component (C) of metallic and/or metalloid elements and/or their oxides, hydroxides, and/or carbonates when used is preferably selected from the group consisting of the oxides, hydroxides, and/or carbonates of silicon, zirconium, and/or aluminum.

The most preferred polymers suitable for component (D) are described in more detail in U.S. Pat. No. 4,963,596, the entire disclosure of which, except to the extent contrary to any explicit statement herein, is hereby incorporated herein by reference. When this component is used, its concentration in a working composition preferably is, with increasing preference in the order given, at least 4.5, 9.0, 18, 40, 80, 150, 250, 300, 350, 400, 450, 470, 490, 510 or 530 milligrams per liter (hereinafter usually abbreviated "mg/L") and independently preferably is, with increasing preference in the order given, not more than 3000, 2000, 1400, 900, or 800 mg/L if maximum resistance to damage during deformation of the treated substrate is required. Otherwise, for greater economy, the concentration of component (D) in a working composition more preferably is, with increasing preference in the order given, not more than 700, 650, 630, 600, 570, 560, 550, 543, or 539 mg/L.

Component (E), when acidity is needed, is preferably selected from among the common inorganic strong acids that do not contain fluorine and preferably also do not contain phosphorus, inasmuch as phosphate ions might interfere with the quality of coatings formed by treatment according to this invention. Sulfuric and hydrochloric acids are suitable, along with nitric acid which is generally most preferred. If an alkaline material is needed for component (E), ammonium or alkali metal carbonates or bicarbonates are preferred. For component (F) if used, hydrofluoric acid and/or acid fluoride salts such as ammonium bifluoride are preferred, with hydrofluoric acid most preferred. Generally these components are not needed in concentrates to be diluted with water to make working compositions, although a small amount of component (E) may often be needed to adjust the pH into the desired range in making working compositions themselves. Components (E) and (F) are commonly present in substantial amounts in replenishment concentrate compositions, as noted further below.

A working composition to be used for treatment by contact with the metal substrate to be treated, followed by rinsing the treated substrate before drying it after such contact, as is the normally preferred process sequence for this invention, preferably has a pH value that is, with increasing preference in the order given, not less than 1.2, 1.6, 2.0, 2.4, 2.6, 2.7, 2.8, or 2.9 and independently preferably is, with increasing preference in the order given, not more than 4.5, 4.2, 4.0, 3.8, 3.7, 3.6, 3.5, 3.4, 3.3, or 3.2.

Independently of all other stated preferences, the molar concentration of total fluorine atoms, irrespective of how such fluorine atoms are chemically bonded, in working compositions according to the invention preferably is, with increasing preference in the order given, not less than 2, 5, 10, 15, 20, 25, 30, 33, 35, 37, 38, or 39 mM and, in a freshly prepared working composition, independently preferably is, with increasing preference in the order given, not more than 200, 100, 80, 70, 65, 60, 55, 50, 48, 46, 44, 43, 42, 41, or 40 mM. However, if the working composition is used to treat aluminum containing metal surfaces, as it often is, aluminum tends to dissolve in the working composition and form substantially undissociated salts and/or complex ions with part of the fluoride content of the working composition and thereby to reduce the free fluoride activity in the working composition. In such cases, the amount of fluoride added to the working composition should be increased to compensate for this effect. Most preferably, the free fluoride content as measured by a fluoride sensitive electrode should be kept approximately constant during use of the working composition, at or near the level characteristic of the particular working composition when it was freshly prepared.

It is normally preferred that compositions according to the invention as defined above should be substantially free from many ingredients used in compositions for similar purposes in the prior art. Specifically, it is often increasingly preferred in the order given, independently for each preferably minimized component listed below, that these compositions, when directly contacted with metal in a process according to this invention, contain no more than 1.0, 0.35, 0.10, 0.08, 0.04, 0.02, 0.01, or 0.001% of each of the following constituents: hexavalent chromium; ferricyanide; ferrocyanide; anions containing molybdenum or tungsten; peroxides and other oxidizing agents (the others being measured as their oxidizing stoichiometric equivalent as peroxide); phosphorus and sulfur containing anions that are not oxidizing agents; and organic compounds having no carboxyl or carboxylate groups but two or more hydroxyl groups per molecule and a molecular weight of less than 300.

Another embodiment of the invention is a process of treating a metal with a composition as described above. In this embodiment of the invention, it is preferred that the metal to be treated be contacted with a composition as described above at a temperature that is not less than, with increasing preference in the order given, 25, 30, 33, 36, 39, 41, 42, or 43° C. and independently preferably is, with increasing preference in the order given, not more than 90, 85, 75, 60, 55, 50, 48, 46, 45, or 44° C. The time of contact between a working composition according to the invention and a metal substrate to be treated preferably is, with increasing preference in the order given, not less than 0.2, 0.4, 0.8, 1.5, 2.5, 3.0, 3.5, 4.0, 4.5, 4.7, or 4.9 seconds (hereinafter usually abbreviated "sec") and independently preferably is, with increasing preference in the order given, not more than 1800, 900, 450, 300, 200, 100, 75, 50, 30, 20, 15, 12, 9, 8, 7, or 6 sec. Independently, it is preferred that the metal surface thus treated be subsequently rinsed with water in one or more stages before being dried. In this embodiment, at least the last, and more preferably all, of the rinsing after treatment with a composition according to this invention preferably is with deionized, distilled, or otherwise purified water, except that the rinse may optionally contain a deliberately added polymer of the type noted above. Also in this embodiment, it is usually fully satisfactory to allow the treated and rinsed substrate to dry spontaneously in air at a normal ambient temperature of 22±5° C. If faster drying is desired, any convenient method, of which many are known per se in the art, may be used; examples are hot air and infrared radiative drying. However, it is preferred that the maximum temperature of the metal reached during drying not exceed, with increasing preference in the order given, 200, 150, 75, 50, 40, or 35° C. and that, independently, drying be completed within a time that is, with increasing preference in the order given, not more than 15, 10, 5, 3, 2, or 1 minute or 30, 20, 15, 10, or 5 sec after the last contact of the treated metal with an aqueous liquid before drying is completed.

As noted above, the treatment compositions according to the invention preferably contain titanium, and when they do, it is preferred that the amount of titanium deposited on a treated metal surface by treatment according to the invention should be, with increasing preference in the order given, at least 0.05, 0.09, 0.13, 0.17, 0.21, 0.25, 0.29, 0.33, 0.38, 0.45, 0.65, 0.90, 1.0, 1.2, 1.3, 1.4, or 1.5, milligrams per square meter (hereinafter usually abbreviated as "mg/m$^2$) of the metal substrate surface treated. Independently, it is preferred that the amount of titanium deposited on a treated metal surface by treatment according to the invention should be not greater than, with increasing preference in the order given, 300, 200, 100, 50, 25, 20, 15, 12, 10, 8, 6.0, 5.7, 5.3, 5.0, or 4.8 mg/m$^2$.

It has been found that, when a composition according to the invention is repeatedly contacted with metal to be treated, as normally occurs when the treatment liquid is recirculated after contact with the metal surfaces to be treated, the acidity of the compositions falls more rapidly than the fluorine content, which in turn falls more rapidly than corresponds to the metal content in fluorometallate component (A). In order to maintain all components within their optimal ranges during prolonged use of a composition according to the invention, it is therefore advantageous to include in the replenishment materials added to the used composition one or both of optional components (E) and (F) as described above, in larger ratios to component (A) than are normally used for these optional components in working compositions or in concentrate compositions for making working compositions by dilution with water. In particular, the molar ratio of the acidity from components (E) and (F) to the molar concentration of titanium in a replenisher concentrate preferably is, with increasing preference in the order given, at least 0.5:1.0, 1.0:1.0, 1.5:1.0, 1.7:1.0, 1.9:1.0, 2.1:1.0, 2.3:1.0, 2.5:1.0, 2.65:1.0, 2.70:1.0, or 2.75:1.0 and independently preferably is, with increasing preference in the order given, not more than 30:1.0, 20:1.0, 15:1.0, 12:1.0, 9.0:1.0, 8.5:1.0, 8.0:1.0, 7.5:1.0, 7.0:1.0, or 6.5:1.0. Also, independently, because component (A) is consumed more rapidly than component (B) by use of the composition, in a replenisher concentrate the total molar concentration of component (B) to the total molar concentration of the elements Ti, Zr, Hf, Al, Si, Ge, Sn, and B in compositions according to the invention preferably is, with increasing preference in the order given, at least 0.01:1.0, 0.03:1.0, 0.05:1.0, 0.09:1.0, 0.13:1.0, 0.16:1.0, 0.19:1.0, 0.21:1.0, 0.23:1.0, 0.25:1.0, or 0.26:1.0 and independently preferably is, with increasing preference in the order given, not more than 1.0:1.0, 0.8:1.0, 0.6:1.0, 0.5:1.0, 0.45:1.0, 0.40:1.0, 0.35:1.0, 0.34:1.0, 0.33:1.0, or 0.32:1.0.

Also, replenisher concentrates for working compositions that initially contain zirconium and/or silicon normally have smaller ratios of zirconium and/or silicon to titanium than working compositions, because titanium appears to be preferentially incorporated into the protective coating formed on the metal surfaces treated. Thus, for replenisher compositions containing zirconium, the molar ratio of zirconium to titanium preferably is, with increasing preference in the order given, from 0.02:1.0 to 1.7:1.0, 0.04:1.0 to 0.9:1.0, 0.06:1.0 to 0.37:1.0, 0.11:1.0 to 0.27:1.0, 0.14:1.0 to 0.24:1.0, 0.16:1.0 to 0.21:1.0, or 0.17:1.0 to 0.19:1.0. Independently, the molar ratio of silicon to titanium in replenisher concentrates that contain silicon preferably is, with increasing preference in the order given, from 0.011:1.0 to 0.89:1.0, 0.019:1.0 to 0.45:1.0, 0.032:1.0 to 0.18:1.0, 0.058:1.0 to 0.14:1.0, 0.073:1.0 to 0.125:1.0, 0.083:1.0 to 0.108:1.0, or 0.090:1.0 to 0.099:1.0.

One type of preferred replenisher includes (A.1) fluotitanic acid and (A.2) fluozirconic acid, (B) gluconic acid, (C) silica, (E) nitric acid, and (F) hydrofluoric acid in ratios by weight of (A.1):(A.2):(B):(C):(E):(F) within the ranges from 20–28:3.5–6.5:8.0–12.0:1.0:8.6–12.6:6.1–12.1, or more preferably within the ranges from 23–25:4.8–5.2:9.2–10.8:1.0:10.1–11.1:8.7–9.4. For example, a preferred specific replenisher concentrate of this type contains 4.0% of 60% $H_2TiF_6$, 2.5% of 20% $H_2ZrF_6$, 1.5% of 70.4% $HNO_3$, 1.9% of 48% HF, 0.1% of $SiO_2$, and 2.0% of 50% gluconic acid.

A second type of preferred replenisher includes (A.1) fluotitanic acid, (A.2) fluozirconic acid, (A.3) fluosilicic acid, (B) gluconic acid, and (E) nitric acid in ratios by weight of (A.1):(A.2):(A.3):(B):(E) within the ranges from 6–18:1.4–5.6:1.0:2–8:2.8–11.2, or more preferably within the ranges from 11.5–13.5:2.4–3.2:1.0:3.6–4.4:5.0–6.2. A preferred specific replenisher of this type includes 5.2% of 60% fluotitanic acid, 3.5% of 20% fluozirconic acid, 1.0% of 25% fluosilicic acid, 2.0% of 50% gluconic acid, and 2.0% of 70.4% nitric acid.

A third type of preferred replenisher, one for a working composition that does not contain either zirconium or silicon, contains (A) fluotitanic acid, (B) gluconic acid, (E) nitric acid, and (F) hydrofluoric acid in ratios by weight of (A):(B):(E):(F) within the ranges from 3–7:1.1–2.1:6.4–14:1.0, or more preferably within the ranges from 4.8–5.2:1.5–1.7:8.8–9.4:1.0. A specific example of this type contains 5.0% of 60% fluotitanic acid solution in water, 0.9% of 70% hydrofluoric acid solution in water, 8.5% of 68% nitric acid solution in water, and 2.0% of 50% gluconic acid solution in water.

Preferably, any make-up or replenisher concentrate contains, with increasing preference in the order given, a total of at least 2, 3, 4, 4.5, 4.8, 5.1, 5.4, or 5.7% of ingredients other than water.

A process according to the invention as generally described in its essential features above may be, and usually preferably is, continued by coating the dried metal surface produced by the treatment as described above with a siccative coating or other protective coating, which is relatively thick compared with the coating formed by the earlier stages of a process according to the invention as described above. Such protective coatings may generally, in connection with this invention, be selected and applied as known per se in the art. Surfaces thus coated have been found to have excellent resistance to subsequent corrosion, as illustrated in the examples below. Particularly preferred types of protective coatings for use in conjunction with this invention include vinyl, acrylic, epoxy, and polyester based paints, enamels, lacquers, and the like.

In a process according to the invention that includes other steps after the formation of a treated layer on the surface of a metal as described above and that operates in an environment in which the discharge of hexavalent chromium is either legally restricted or economically handicapped, it is generally preferred that none of these other steps include contacting the surfaces with any composition that contains more than, with increasing preference in the order given, 1.0, 0.35, 0.10, 0.08, 0.04, 0.02, 0.01, 0.003, 0.001, or 0.0002% of hexavalent chromium. Examples of suitable and preferred chromium free treatments are described in U.S. Pat. No. 4,963,596.

Preferably, the metal surface to be treated according to the invention is first cleaned of any contaminants, particularly organic contaminants and foreign metal fines and/or inclusions. Such cleaning may be accomplished by methods known to those skilled in the art and adapted to the particular type of metal substrate to be treated. For example, for aluminum, the surface to be treated most preferably is first contacted with a conventional hot alkaline cleaner, then rinsed in hot water, then, optionally, contacted with a neutralizing acid rinse, before being contacted with an acid aqueous composition according to this invention as described above.

The practice of this invention may be further appreciated by consideration of the following, non-limiting, working examples.

TEST METHODS AND OTHER GENERAL CONDITIONS

The "0-T Bend" column in the following tables reports the result of a test procedure as follows:

1. Perform a 0-T bend in accordance with ASTM Method D4145-83.
2. Firmly apply one piece of #610 Scotch™ tape to the area of the test panel with the O-T bend and to the adjacent flat area.
3. Slowly pull the tape off from the bend and the adjacent flat area.
4. Repeat steps 2 and 3, using a fresh piece of tape for each repetition, until no additional paint is removed by the tape.
5. Report the maximum distance from the 0-T bend into the flat area from which paint removal is observed according to the scale below:

| Paint loss in mm | Rating |
|---|---|
| 0 | 5.0 |
| 0.20 | 4.9 |
| 0.30 | 4.8 |
| 0.8 | 4.5 |
| 1.6 | 4.0 |
| 2.4 | 3.5 |
| 3.2 | 3.0 |
| 4.0 | 2.5 |
| 4.8 | 2.0 |
| 5.6 | 1.5 |
| 6.4 | 1.0 |
| 7.2 | 0.5 |
| >7.2 | 0 |

The "Cross Hatch" and "Blisters" Tests were performed as follows:

1. Crosshatch the painted sample—two perpendicular cuts; a Gardner crosshatch tool with 11 knife edges spaced 1.5 mm apart was used.
2. Firmly apply #610 Scotch™ tape to the crosshatched area and remove tape.
3. Examine the crosshatched area for paint not removed by the tape and report a number representing one-tenth of the percentage of paint remaining.
4. Using a microscope at 3–6 times magnification, visually observe the treated surface for blistering, and rate the density of blisters per area of 6.5 square centimeters of the surface according to the following scale:

| No. of Blisters: | 0 | 1–5 | 6–10 | 11–15 | 16–25 | 26–50 | 51–100 | >100 |
|---|---|---|---|---|---|---|---|---|
| Rating: | 5.0 | 4.5 | 4.0 | 3.5 | 3.0 | 2.0 | 1.0 | 0.0 |

The "Feathering" test was performed as follows: Using a utility knife, scribe a slightly curved "V" on the back side of the test panel. Using scissors, cut up about 12 millimeters (hereinafter "mm") from the bottom along the scribe. Bend the inside of the V away from the side for testing. Place the sample in a vise and, using pliers, pull from the folded section with a slow continuous motion. Ignore the part of the panel between the top edges nearest to the vertex and a line parallel to the top edge but 19 mm away from it. On the remainder of the panel, measure to edge of feathering in mm. Record the largest value observed.

The Blisters, Cross Hatch, and Feathering tests were normally made after exposing test panels to various aqueous environments as follows:

"Ninety Minute Steam Exposure" means exposing the painted samples to steam at a temperature of 120° C. for 90 minutes in a pressure cooker or autoclave.

"15 Minute Boiling DOWFAX™ 2A1 Immersion" (abbreviated "Boiling Dowfax™ Sol'n") means boiling for 15 minutes in a 1% by volume of DOWFAX™ 2A1 in deionized water; then removing the panels, rinsing with water, and drying. DOWFAX™ 2A1 is commercially available from Dow Chemical and is described by the supplier as 45% active sodium dodecyl diphenyloxide disulfonate in water.

"Hot Deionized Water" means 30 minutes exposure to deionized water at 68.3° C.

GROUP 1

In this Group, the effect of gluconic acid and other candidate additions to the working compositions was explored, using test substrate pieces of Type 5042 or 5182 aluminum, which were spray cleaned for 10–15 sec at 51.7–54.4° C. with an aqueous cleaner containing 24 g/L of PARCO® Cleaner 305 (commercially available from the Parker Amchem Division of Henkel Corp., Madison Heights, Mich., U.S.A.). After cleaning, the panels were rinsed about 5 sec with hot water; then they were sprayed for 3–5 seconds with the respective treatment solutions described below, then were rinsed with cold tap water, then with deionized water, or in some cases where particularly noted, a polymer solution made up in deionized water, before being dried and subsequently painted.

The inorganic make-up concentrate for these experiments is denoted herein as "Concentrate 1" and had the following ingredients in addition to water:

4.19% of 60% $H_2TiF_6$ solution 0.27% of Cab-O-Sil™ M-5 fumed amorphous silicon dioxide, and 0.92% of basic zirconium carbonate (containing 29% Zr).

These ingredients were simply mixed together with mechanical agitation in the order shown, with a pause after each addition until the solution became optically clear. Although the partial mixture was not transparent immediately after addition of the silicon dioxide, it became clear after a few minutes of mixing, even without any heating.

Working compositions were prepared by taking 250 grams of Concentrate 1 (Example 1.1), and in specific cases as indicated also 1.8 grams of sodium gluconate (Example 1.2), sodium citrate (Example 1.3), or ethylene diamine tetraacetic acid (Example 1.4), diluting to slightly less than 6 liters with tap water, adjusting the pH with sodium carbonate, and then adjusting to exactly 6 liters with tap water. These working compositions were then used in the general process sequence described above at a treatment temperature of 51.7° C., the treated and dried substrates being painted with Valspar™ 9009-157 paint. Test results and pH values are shown in Table 1.

TABLE 1

| Example | | mg of | | 90 Minute Steam Exposure | |
|---|---|---|---|---|---|
| Number | pH | Ti/m$^2$ | O–T Bend | Cross Hatch | Blistering |
| 1.1 | 3.0 | 3.5 | 4.3 | 10 | 2.0 |
| 1.2 | 3.1 | 2.2 | 4.3 | 10 | 5.0 |
| 1.3 | 3.3 | 1.5 | 5.0 | 10 | 3.0 |
| 1.4 | 3.4 | 4.5 | 4.5 | 10 | 0.0* |

*There were numerous small blisters 0.05 mm or less in size

GROUP 2

In this group (Comparison Example 2.1 and Examples 2.2–2.3), thermal stability of working compositions was measured. For these examples. 41.7 grams of Concentrate 1 was diluted to 1000 grams with tap water, and sodium carbonate was added to give a pH of about 3.0. Sodium gluconate was added to Examples 2.2 and 2.3 in amounts of 300 and 500 parts per million respectively. Samples of the three compositions were placed in a transparent container on a hotplate and heated to an internal temperature of 74–77° C. Results and pH values of the compositions are shown in Table 2.

TABLE 2

| Number | pH | Results |
|---|---|---|
| 2.1 | 3.0 | Sample became turbid within 5 minutes and very turbid after 15 minutes. |
| 2.2 | 3.1 | Sample became turbid within 15 minutes and very turbid after 30 minutes. |
| 2.3 | 3.2 | Sample remained clear after 1.5 hours. |

GROUP 3

In Examples 3.1–3.4, the working composition was the same as for Example 1.2 above except that the pH was 3.0, and the substrate metals and process conditions were the same except that the temperature during contact of the working composition with the aluminum substrate was varied as shown in Table 3. Test results are also shown in Table 3.

TABLE 3

| Example | | mg of | | 90 Minute Steam Exposure* | |
|---|---|---|---|---|---|
| Number | °C. | Ti/m$^2$ | O–T Bend* | Cross Hatch | Blistering |
| 3.1 | 37.8 | 1.0 | $4.9_5$ | 10 | 5.0 |
| 3.2 | 48.9 | 1.6 | $4.9_5$ | 10 | 5.0 |

TABLE 3-continued

| Example | | mg of | | 90 Minute Steam Exposure* | |
|---|---|---|---|---|---|
| Number | °C. | Ti/m$^2$ | O–T Bend* | Cross Hatch | Blistering |
| 3.3 | 60.0 | 3.7 | 4.9 | 10 | $4.7_5$ |
| 3.4 | 71.1 | 4.5 | 4.6 | 10 | 2.5 |

*Figures shown in columns under a heading including an asterisk are averages of two measurements.

GROUP 4

In Examples 4.1–4.3, the amount of sodium gluconate was varied over a wider range than in the previous examples with corrosion test results reported. Working compositions for these examples were made in the same manner as those for Examples 1.1 (for 4.1) or 1.2 (for 0.2 and 0.3), except that the pH was slightly varied from the previous values and that the amount of gluconate was derived from 0.6 grams of added sodium gluconate for 4.2 and 0.6 grams of sodium gluconate plus 4.8 grams of 50% gluconic acid for 4.3. The temperature was 51.7° C. during treatment of the metal substrates, which were the same and were processed in the same way before and after treatment with these working compositions according to this invention as for Groups 1 and 3. Test results and pH values are shown in Table 4.

TABLE 4

| Example | | mg of | | 90 Minute Steam Exposure* | |
|---|---|---|---|---|---|
| Number | °C. | Ti/m$^2$ | O–T Bend* | Cross Hatch | Blistering |
| 4.1 | 3.0 | 2.7 | 4.4 | 10 | 5.0 |
| 4.2 | 3.0 | 2.3 | 5.0 | 10 | 5.0 |
| 4.3 | 3.0 | 0.5 | 5.0 | 10 | 5.0 |

*Figures shown in columns under a heading including an asterisk are averages of two measurements.

GROUP 5

For this group, "Concentrate 2" was used. This had the same composition as Concentrate 1, except that it additionally contained 2.15% of 50% gluconic acid and 0.10% of a 32–33% solids content polymer solution that was made according to the directions of column 11 lines 39–49 of U.S. Pat. No. 4,963,596, except as follows: The preparation was carried out on a substantially larger scale; the proportions of ingredients were changed to the following: 241 parts of Propasol™ P, 109 parts of Resin M, 179 parts of N-methylglucamine, 73.5 parts of aqueous 37% formaldehyde, and 398 parts of deionized water, of which 126 parts were reserved for a final addition not described in the noted patent, with the remainder used to slurry the N-methylglucamine as noted in the patent; and the temperature noted as 60–65° C. in the patent was reduced to 57° C.

Working compositions were prepared by diluting 250 grams of Concentrate 2 to 6 liters of working composition with tap water, then adjusting the pH to 3.0 with 10% sodium carbonate solution. After 3 seconds of treatment with this solution at temperatures shown in Table 5. some test substrate panels, which were of the same aluminum alloys and were treated in the same way (except as otherwise specified) before and after treatment with these working compositions as in Groups 1, 3, and 4, were rinsed with deionized water (denoted "DIW" in Tables 5A and 5B below) and others with a solution containing 30 milliliters (hereinafter usually abbreviated "mL") of PARCOLENE™ 95-AT (commercially available from the Parker Amchem Division of Henkel Corporation, Madison Heights, Mich.) and 1.5 mL of 25% aqueous $H_3PO_4$ in 6 liters made to volume with deionized water (this polymer containing rinsing solution having a pH of 4.9 and being denoted "PR" in Tables 5A and 5B below) at 60° C. for 3 seconds before being dried. Paints were Valspar™ 9009-139 (denoted "139" in Table 5A), Valspar™ 9009-157 (denoted "157" in Table 5A), and Valspar™ 9835-001 (for the examples shown in Table 5B). Results are shown below in Tables 5A (for Type 5042 aluminum alloy) and 5B (for Type 5182 aluminum alloy).

TABLE 5A

| Ex. | | | | mg of | | 90 Min. Steam Exposure | |
|---|---|---|---|---|---|---|---|
| No. | Paint | Rinse | °C. | Ti/m$^2$ | O–T Bend | Cross Hatch | Blistering |
| 5.1 | 139 | DIW | 51.7 | 2.0 | 4.8 | 10.0 | 4.5 |
| 5.2 | 139 | PR | 51.7 | 2.0 | 4.9 | 10.0 | 4.5 |
| 5.3 | 139 | DIW | 65.6 | 4.6 | 4.8 | 10.0 | 4.5 |
| 5.4 | 139 | PR | 65.6 | 4.6 | 5.0 | 10.0 | 4.5 |
| 5.5 | 157 | DIW | 51.7 | 2.0 | 4.8 | 10.0 | 4.5 |
| 5.6 | 157 | PR | 51.7 | 2.0 | 5.0 | 10.0 | 5.0 |
| 5.7 | 157 | DIW | 65.6 | 4.6 | 4.7 | 10.0 | 4.5 |
| 5.8 | 157 | PR | 65.6 | 4.6 | 4.9 | 10.0 | 4.5 |

TABLE 5B

| | | | | Hot Deionized Water | | Boiling Dowfax ™ Sol'n | |
|---|---|---|---|---|---|---|---|
| Ex. No. | °C. | Rinse | mg of Ti/m$^2$ | Cross Hatch | Feathering | Cross Hatch | Feathering |
| 5.9 | 51.7 | DIW | 0.8 | 10.0 | 0.6 mm | 10.0 | 0.6 mm |
| 5.10 | 51.7 | PR | 0.8 | 10.0 | 0.2 mm | 10.0 | 0.1 mm |
| 5.11 | 65.6 | DIW | 4.4 | 10.0 | 0.9 mm | 10.0 | 0.4 mm |
| 5.12 | 65.6 | PR | 4.4 | 10.0 | 0.2 mm | 10.0 | 0.1 mm |

GROUP 6

For this group, a concentrate denoted "Concentrate 3" was prepared; it contained the following parts by weight in a total of 1000 parts by weight, with the balance not shown being deionized water: 41.9 of 60% fluotitanic acid; 25.9 of 25% fluosilicic acid; 30.7 of 20% fluozirconic acid; and 21.5 of 50% gluconic acid. To prepare working compositions, 250 grams of this concentrate were diluted to 6 liters with tap water and the pH adjusted to 3.0 with 10% sodium carbonate solution. Test panels of the same type were treated with these working compositions in the same manner as for Group 3 above, except that some panels, with Example Numbers including .1.", were painted with Valspar™ 9009-139 paint instead of 9009-157, while those with Example Numbers including ".2." were painted with the same paint as before. Results are shown in Table 6.

TABLE 6

| Example | | mg of | | 90 Minute Steam Exposure | |
|---|---|---|---|---|---|
| Number | °C. | Ti/m$^2$ | O–T Bend | Cross Hatch | Blistering |
| 6.1.1 | 37.8 | 0.7 | 4.6 | 10 | 5.0 |
| 6.1.2 | 48.9 | 1.2 | 4.6 | 10 | 5.0 |

TABLE 6-continued

| Example Number | °C. | mg of Ti/m² | O–T Bend | 90 Minute Steam Exposure Cross Hatch | Blistering |
|---|---|---|---|---|---|
| 6.1.3 | 60.0 | 0.6 | 4.5 | 10 | 4.5 |
| 6.2.1 | 37.8 | 0.7 | 4.8 | 10 | 5.0 |
| 6.2.2 | 48.9 | 1.2 | 4.7 | 10 | 4.5 |
| 6.2.3 | 60.0 | 0.6 | 4.8 | 10 | 5.0 |

GROUP 7

This group was the same as Group 6, except that the concentrate did not contain the fluosilicic acid used in Concentrate 3 and the pH was 3.0, but the other ingredients except water were used in the same numbers of parts as for Concentrate 3. Results are shown in Table 7.

TABLE 7

| Example Number | °C. | mg of Ti/m² | O–T Bend | 90 Minute Steam Exposure Cross-Hatch | Blistering |
|---|---|---|---|---|---|
| 7.1.1 | 37.8 | 0.2 | 4.5 | 10 | 5.0 |
| 7.1.2 | 48.9 | 0.8 | 4.7 | 10 | 5.0 |
| 7.1.3 | 60.0 | 3.0 | 4.2 | 10 | 5.0 |
| 7.2.1 | 37.8 | 0.2 | 4.8 | 10 | 4.5 |
| 7.2.2 | 48.9 | 0.8 | 4.5 | 10 | 5.0 |
| 7.2.3 | 60.0 | 3.0 | 4.6 | 10 | 4.5 |

GROUP 8

For this group, a concentrate denoted "Concentrate 4" was prepared, containing the following parts by weight in a total of 1000 parts by weight, with the balance not shown being deionized water: 21.5 of 60% fluotitanic acid; 25.9 of 25% fluosilicic acid; 30.7 of 20% fluozirconic acid; and 21.5 of 50% gluconic acid. To prepare working compositions, 250 grams of this concentrate were diluted to 6 liters with tap water and the pH was adjusted to 3.0 with sodium carbonate. Test panels were treated with these working compositions in the same manner as for Group 3 above, except that some panels, with Example Numbers including ".1.", were painted with Valspar™ 9009-139 paint instead of 9009-157, while those with Example Numbers including ".2." were painted with the same paint as before. Results are shown in Table 8.

TABLE 8

| Example Number | °C. | mg of Ti/m² | O–T Bend | 90 Minute Steam Exposure Cross Hatch | Blistering |
|---|---|---|---|---|---|
| 8.1.1 | 37.8 | <0.1 | 4.8 | 10 | 5.0 |
| 8.1.2 | 48.9 | 0.2 | 4.6 | 10 | 4.5 |
| 8.1.3 | 60.0 | 0.6 | 4.4 | 10 | 5.0 |
| 8.2.1 | 37.8 | <0.1 | 4.7 | 10 | 5.0 |

TABLE 8-continued

| Example Number | °C. | mg of Ti/m² | O–T Bend | 90 Minute Steam Exposure Cross Hatch | Blistering |
|---|---|---|---|---|---|
| 8.2.2 | 48.9 | 0.2 | 4.8 | 10 | 4.5 |
| 8.2.3 | 60.0 | 0.6 | 4.5 | 10 | 3.0 |

GROUP 9

This group was the same as Group 8, except that "Concentrate 5" was used; this did not contain the fluosilicic acid used in Concentrate 4, and the parts of 60% fluotitanic acid were increased to 33.8, but other ingredients except water were used in the same number of parts as for Concentrate 4. Results are shown in Table 9.

TABLE 9

| Example Number | °C. | mg of Ti/m² | O–T Bend | 90 Minute Steam Exposure Cross Hatch | Blistering |
|---|---|---|---|---|---|
| 9.1.1 | 37.8 | 0.4 | 4.7 | 10 | 4.5 |
| 9.1.2 | 48.9 | 0.3 | 4.8 | 10 | 5.0 |
| 9.1.3 | 60.0 | 1.7 | 4.7 | 10 | 5.0 |
| 9.2.1 | 37.8 | 0.4 | 4.6 | 10 | 4.5 |
| 9.2.2 | 48.9 | 0.3 | 4.8 | 10 | 4.5 |
| 9.2.3 | 60.0 | 1.7 | 4.7 | 10 | 5.0 |

GROUP 10

In this group Types 5352 and MD-301 aluminum alloys were used, along with Concentrate 6, which contained the following parts by weight in a total of 1000 parts by weight, with the balance not shown being deionized water: 17.5 of 60% fluotitanic acid; 9.0 of 50% gluconic acid. 65.2 of 70.5% nitric acid; and 50.0 of concentrated ammonium hydroxide in water containing 29.9% ammonia equivalent. The specific gravity of this concentrate was 1.030. 600 mL of this concentrate was used, together with other ingredients as shown in Table 10.1 below and tap water, to make 6 liter volumes of working compositions used in Step 3 of the following processing sequence:

1. Spray clean for 7 sec in a solution containing 15 points of PARCO® Cleaner 305 (commercially available from the Parker Amchem Division of Henkel Corporation, Madison Heights, Mich.) at 54.4° C.
2. Spray rinse for 5 sec in warn water.
3. Spray treat with composition according to the invention for 5 sec at 43.3° C. (unless otherwise noted).
4. Spray rinse with cold water for 5 sec.
5. Spray rinse with DIW for 5 sec.
6. Squeegee and allow to air-dry.

Characteristics of the treatment compositions and the amounts of titanium in the coatings formed are shown in Table 10.1, and test results from using these treatment compositions are shown in Tables 10.2 and 10.3.

TABLE 10.1

| Treatment Composition Number | Content, in 6 Liters of Working Composition, of: mL of 3.5% $HNO_3$ in $H_2O$ | mL of 10% $NH_4HCO_3$ in $H_2O$ | Grams of 32% Polymer Solution[1] in $H_2O$ | pH of Working Composition | mg/m$^2$ of Titanium on Substrate of Alloy: 5352 | MD-301 |
|---|---|---|---|---|---|---|
| 10.W.1 | — | 11.0 | 0 | 2.9 | 3.8 | 4.8 |
| 10.W.2 | — | 11.0 | 5 | 3.0 | 3.8 | 5.6 |
| 10.W.3 | 8 | 11.0 | 10 | 3.0 | 4.4 | 5.2 |
| 10.W.4 | 16 | 11.0 | 15 | 3.1 | 3.7 | 5.6 |
| 10.W.5 | 25 | 11.0 | 20 | 3.1 | 3.5 | 4.9 |
| 10.W.6[2] | 25 | — | 50 | 3.1 | 4.8 | 7.0 |

[1]This was the same polymer solution as was described as part of Group 5.
[2]This treatment was used at 54.4° C. instead of 43.3° C. as were the others in this table.

TABLE 10.2

| Example Number | Treatment Composition Number | Boiling Dowfax ™ Sol'n Test Results: Cross-Hatch | Feathering | Hot Deionized Water Exposure Test Results: Cross-Hatch | Feathering |
|---|---|---|---|---|---|
| 10.P.1 | 10.W.1 | 10 | 0.40 mm | 10 | 0.15 mm |
| 10.P.2 | 10.W.2 | 10 | 0.35 mm | 10 | 0.25 mm |
| 10.P.3 | 10.W.3 | 10 | 0.40 mm | 10 | 0.15 mm |
| 10.P.4 | 10.W.4 | 10 | 0.25 mm | 10 | 0.15 mm |
| 10.P.5 | 10.W.5 | 10 | 0.20 mm | 10 | 0.05 mm |
| 10.P.6 | 10.W.6 | 10 | 0.20 mm | 10 | 0.20 mm |

Notes for Table 10.2
The substrate for these examples was always MD-301 alloy and the paint was Valspar ™ Type 9835-001.

TABLE 10.3

| Example Number | Substrate Alloy | Treatment Composition Number | Valspar ™ Paint Type Used | 0–T Bend Test Results | Ninety Minute Steam Exposure Test Results: Cross-Hatch | Blisters |
|---|---|---|---|---|---|---|
| 10.P.7 | 5352 | 10.W.1 | 9009-139 | 4.5, 4.2 | 10, 10 | 5, 5 |
| 10.P.8 | 5352 | 10.W.2 | 9009-139 | 4.8, 4.8 | 10, 10 | 5, 5 |
| 10.P.9 | 5352 | 10.W.3 | 9009-139 | 4.9, 4.9 | 10, 10 | 5, 5 |
| 10.P.10 | 5352 | 10.W.4 | 9009-139 | 5.0, 5.0 | 10, 10 | 5, 5 |
| 10.P.11 | 5352 | 10.W.5 | 9009-139 | 5.0, 5.0 | 10, 10 | 5, 5 |
| 10.P.12 | 5352 | 10.W.6 | 9009-139 | 4.8, 4.8 | 10, 10 | 5, 5 |
| 10.P.13 | MD301 | 10.W.1 | 92X205B | | 10, 10 | 5, 5 |
| 10.P.14 | MD301 | 10.W.2 | 92X205B | | 10, 10 | 5, 5 |
| 10.P.15 | MD301 | 10.W.3 | 92X205B | | 10, 10 | 5, 5 |
| 10.P.16 | MD301 | 10.W.4 | 92X205B | | 10, 10 | 5, 5 |
| 10.P.17 | MD301 | 10.W.5 | 92X205B | | 10, 10 | 5, 5 |
| 10.P.18 | MD301 | 10.W.6 | 92X205B | | 10, 10 | 5, 5 |

Notes for Table 10.3
A blank space indicates no corresponding test was performed.
Two entries in a space are individual results from duplicate tests.

GROUP 11

Two concentrates were prepared for this group of examples. Their compositions are shown in Table 11.1 below, except that the balance not shown in the table was deionized water for both concentrates.

TABLE 11.1

| Ingredient | Percent of Ingredient in Composition Number: 11.C.1 | 11.C.2 |
|---|---|---|
| 60% $H_2TiF_6$ solution in water | 1.75 | 4.19 |
| 20% $H_2ZrF_6$ solution in water | — | 3.07 |
| 50% Gluconic acid solution in water | 0.90 | 2.15 |
| 70.8% $HNO_3$ in water | 6.52 | — |
| $NH_4OH$ solution in water containing the stoichiometric equivalent of 29.9% $NH_3$ | 5.00 | — |

Two working compositions were prepared from these concentrates. The constituents of 6 liters of each of the working compositions are shown in Table 11.2 below, except that the balance not shown in the table was tap water for both compositions. The pH of both of these compositions was 3.0

TABLE 11.2

| Ingredient | Amount of Ingredient in Composition Number: 11.W.1 | 11.W.2 |
|---|---|---|
| Concentrate 11.C.1 | 600mL | — |
| Concentrate 11.C.2 | — | 240mL |
| 32–33% Polymer Solution[1] in water | 10grams | 10grams |
| 70.8% $HNO_3$ in water | — | 39.1grams |
| $NH_4OH$ solution in water containing the stoichiometric equivalent of 29.9% $NH_3$ | — | 43.0mL |

[1]This was the same polymer solution as is described for Group 5 herein.

Test panels of the same types of aluminum alloy as for Group 1 were subjected to the same process sequence as in Group 10, except for substituting the working treatment compositions shown in Table 11.2. The amount of Ti deposited was 3.8 mg/m$^2$ for Composition 11.W.1 and 3.2 mg/m$^2$ for Composition 11.W.2. Five test panels were used with each of these working compositions and then painted with Valspar™ 9009-139 paint and subjected to the 0-T Bend and Ninety Minute Steam Exposure Tests. All ten panels had the highest possible ratings for both Cross-Hatch and Blisters in the Ninety Minute Steam Exposure Test, and every one of the panels had a rating of either 4.8 or 4.9 in the 0-T Bend Test.

GROUP 12

In this group, tannic acid was compared with another type of polymer suitable for component (D) of a composition according to the invention. Make-up "Concentrates 12.C.1" and "12.C.2" had the compositions shown in Table 12.1, except that the balance not shown was deionized water.

TABLE 12.1

| Ingredient | Percent of Ingredient in Concentrate Number: 12.C.1 | 12.C.2 |
|---|---|---|
| 60% $H_2TiF_6$ solution in water | 4.19 | 4.19 |
| 20% $H_2ZrF_6$ solution in water | — | 3.07 |
| Zirconium Basic Carbonate (29% Zr) | 0.92 | — |
| 50% Gluconic acid solution in water | 2.15 | 2.15 |

Ingredients other than tap water in the working compositions made from these two concentrates are shown in Table 12.2 and its notes. Test substrates of Type 5050 aluminum alloy were used, and the processing sequence was the same as for Group 10 above except as otherwise explicitly noted. Performance test results obtained with these working compositions are shown in Table 12.3 and its notes.

TABLE 12.2

| Amounts, per 6 L of Working Composition, of: | Value of Characteristic for Working Composition 12.W: .1 | .2 | .3 | .4 | .5 | .6 | .7 | .8 |
|---|---|---|---|---|---|---|---|---|
| mL of 12.C.1 | 240 | 240 | 240 | 240 | — | — | — | — |
| mL of 12.C.2 | — | — | — | — | 240 | 240 | 240 | 240 |
| mL of 29.8% $NH_3$ in $H_2O$ | 41 | 43 | 43 | 47 | 43 | 47 | 43 | 47 |
| g of 25% $H_2SiF_6$ in $H_2O$ | — | 6.2 | — | 6.2 | — | 6.2 | — | 6.2 |
| g of Polymer Solution[1] | 10 | 10 | — | — | 10 | 10 | — | — |
| g of 5% Tannic Acid in $H_2O$[2] | — | — | 60 | 60 | — | — | 60 | 60 |
| pH | 3.0 | 3.0 | 3.0 | 3.03 | 3.0 | 3.1 | 3.0 | 3.0 |

Footnotes for Table 12.2

[1]This was the same polymer solution as for Group 10.

[2]The tannic acid solution used also contained 0.16% of sodium hydroxide (rayon grade) and 0.1% of potassium sorbate.

Other Note for Table 12.2

Every working composition in the Table also contained 39.1 g of 70.8% nitric acid in water per 6 liters of working composition.

TABLE 12.3

| Characteristic of the Process Used and/or the Resulting Treated Substrate: | Value of Characteristic for Working Composition 12.W: .1 | .2 | .3 | .4 | .5 | .6 | .7 | .8 |
|---|---|---|---|---|---|---|---|---|
| Temperature of Treatment, °C. | 43.3 | 54.4 | 54.4 | 54.4 | 54.4 | 54.4 | 54.4 | 54.4 |
| mg/m$^2$ of Ti Deposited | 4.0 | 3.7 | 3.1 | 3.4 | 4.6 | 1.9 | 3.8 | 2.0 |

TABLE 12.3-continued

| Characteristic of the Process Used and/or the Resulting | Value of Characteristic for Working Composition 12.W: | | | | | | | |
|---|---|---|---|---|---|---|---|---|
| Treated Substrate: | .1 | .2 | .3 | .4 | .5 | .6 | .7 | .8 |
| Values of 0–T Ratings | 4.9, 4.8 | 4.9, 4.9 | 4.6, 4.7 | 4.3, 4.5 | 4.9, 4.9 | 4.8, 4.8 | 4.5, 4.5 | 4.5, 4.3 |

Notes for Table 12.3
Values shown are for both duplicates in the 0–T Rating test.
All of these examples were painted with Valspar ™ 9009-139 paint and achieved ratings of 10 for Cross-Hatch and 5 for Blisters in the 90 Minute Steam Exposure Test on both of duplicate tested samples in these tests.

GROUP 13

This group of examples was designed to examine the effect of temperature of treatment according to the invention, and the associated variation in coating weights, on the results achieved with a substantially constant treatment composition. At the beginning of these examples, the treatment composition was the same as Composition No. 11.W.1 described under Group 11, except that it had 1.5 times as much of the same Polymer Solution, the amount of water was reduced accordingly, and it had a pH of 3.0 The composition was initially heated to a temperature of 32.2° C. and used to treat several test panels in a process sequence that was the same as for Group 10, except for the different temperature of the treatment composition according to the invention. The temperature of the treatment composition was then raised in increments, with several panels being treated at each temperature. At the end of the treatments, the pH of the treatment composition was again measured and was found to have risen to 3.2. and analysis indicated that the concentration of organic polymer in the treatment composition had diminished by about 10% from its starting value. Other results of these examples are shown in Tables 13.1 and 13.2 below.

TABLE 13.1

| Example | Temperature, | mg/m$^2$ of Ti | Boiling Dowfax ™ Sol'n Test Results | | Hot Deionized Water Exposure Test Results | |
|---|---|---|---|---|---|---|
| Number | °C. | Deposited | Cross-Hatch | Feathering | Cross-Hatch | Feathering |
| 13.P.1 | 32 | 2.5 | 10 | 0.15 mm | 10 | 0.30 mm |
| 13.P.2 | 38 | 3.6 | 10 | 0.20 mm | 10 | 0.20 mm |
| 13.P.3 | 43 | 4.4 | 10 | 0.15 mm | 10 | 0.15 mm |
| 13.P.4 | 49 | 6.6 | 10 | 0.10 mm | 10 | 0.15 mm |
| 13.P.5 | 54 | 10.7 | 10 | 0.10 mm | 10 | 0.15 mm |
| 13.P.6 | 60 | 11.5 | 10 | 0.10 mm | 10 | 0.45 mm |

Notes for Table 13.1
The substrate for these examples was always MD-301 alloy and the paint was Valspar ™ Type 9835-001.

TABLE 13.2

| Example | Substrate | Temperature, | mg/m$^2$ of Ti | Valspar ™ Paint | 0–T Bend | Ninety Minute Steam Exposure Test Results | |
|---|---|---|---|---|---|---|---|
| Number | Alloy | °C. | Deposited | Type Used | Test Results | Cross-Hatch | Blisters |
| 13.P.7 | 5352 | 32 | 1.0 | 9009-139 | 4.7, 4.7 | 10, 10 | 5, 5 |
| 13.P.8 | 5352 | 38 | 2.4 | 9009-139 | 4.9, 4.9 | 10, 10 | 5, 5 |
| 13.P.9 | 5352 | 43 | 3.4 | 9009-139 | 5.0, 5.0 | 10, 10 | 5, 5 |
| 13.P.10 | 5352 | 49 | 4.1 | 9009-139 | 5.0, 5.0 | 10, 10 | 5, 5 |
| 13.P.11 | 5352 | 54 | 6.6 | 9009-139 | 4.8, 4.8 | 10, 10 | 5, 5 |
| 13.P.12 | 5352 | 60 | 8.0 | 9009-139 | 4.8, 4.8 | 10, 10 | 5, 5 |
| 13.P.13 | MD301 | 32 | 2.5 | 92X-205B | | 10, 10 | 5, 5 |
| 13.P.14 | MD301 | 38 | 3.6 | 92X-205B | | 10, 10 | 5, 5 |
| 13.P.15 | MD301 | 43 | 4.4 | 92X-205B | | 10, 10 | 5, 5 |
| 13.P.16 | MD301 | 49 | 6.6 | 92X-205B | | 10, 10 | 5, 5 |
| 13.P.17 | MD301 | 54 | 10.7 | 92X-205B | | 10, 10 | 5, 5 |
| 13.P.18 | MD301 | 60 | 11.5 | 92X-205B | | 10, 10 | 5, 5 |

Notes for Table 13.2
A blank space indicates no corresponding test was performed. Two entries in a space are individual results from duplicate tests.

The invention claimed is:

1. An aqueous liquid composition that is suitable either as such or after dilution with water for treating metal surfaces to improve the corrosion resistance thereof, said composition consisting essentially of water and:

(A) a component selected from the group consisting of $H_2TiF_6$, $H_2ZrF_6$, $H_2HfF_6$, $H_2SiF_6$, $H_2GeF_6$, $H_2SnF_6$, $HBF_4$, and mixtures thereof; and (B) a component selected from the group consisting of water soluble organic carboxylic acids that contain at least two hydroxyl groups, exclusive of hydroxyl groups that are part of the carboxyl groups, per carboxyl group in each acid molecule, the water soluble salts of such acids, and mixtures of any two or more of these acids and salts; wherein the concentration of component (B) is at least 1.075% of the total composition.

2. A composition according to claim 1, which contains a total of at least about 4% of components (A), (B), and the following optional components:

(C) a component selected from the group consisting of Ti, Zr, Hf, Al, Si, Ge, Sn, and B, the oxides, hydroxides, and carbonates of Ti, Zr, Hf, Al, Si, Ge, Sn, and B, and mixtures of any two or more of these elements, oxides, hydroxides, and carbonates;

(E) a pH adjusting component selected from the group consisting of inorganic acids and inorganic alkaline materials that do not contain fluorine; and (F) a component selected from the group consisting of inorganic acids that contain fluorine but do not contain any of the elements Ti, Zr, Hf, Al, Si, Ge, Sn, and B, wherein component (A) is selected from the group consisting of $H_2TiF_6$, $H_2ZrF_6$, $H_2SiF_6$, and mixtures thereof and includes at least some $H_2TiF_6$; the ratio of the molar concentration of component (B) to the molar concentration of the element Ti in the composition is from about 1.1:7 to about 2.1:3; at least one of components (E) and (F) is present, and the ratio of the moles of acidity from components (E) and (F) to the moles of titanium present in the composition is from about 2.5:1.0 to about 9.8:1.0.

3. A composition according to claim 2, which contains a total of at least 4.8% of components (A), (B), and the following optional components:

(C) a component selected from the group consisting of Ti, Zr, Hf, Al, Si, Ge, Sn, and B, the oxides, hydroxides, and carbonates of Ti, Zr, Hf, Al, Si, Ge, Sn, and B, and mixtures of any two or more of these elements, oxides, hydroxides, and carbonates;

(E) a pH adjusting component selected from the group consisting of inorganic acids and inorganic alkaline materials that do not contain fluorine; and (F) a component selected from the group consisting of inorganic acids that contain fluorine but do not contain any of the elements Ti, Zr, Hf, Al, Si, Ge, Sn, and B, wherein the ratio of the molar concentration of component (B) to the molar concentration of the element Ti in the composition is from about 1.5:5.2 to about 1.7:4.8 and the ratio of the moles of acidity from components (E) and (F) to the moles of titanium present in the composition is from about 2.75:1.0 to about 7.5:1.0.

4. A composition according to claim 1, wherein: (i) component (A) includes $H_2TiF_6$; (ii) component (B) is selected from monobasic acids with from three to twelve carbon atoms per molecule and salts thereof; (iii) the ratio of the molar concentration of component (B) to the molar concentration of the element Ti in the composition is from about 0.04:1.0 to about 1.2:1.0; (iv) there is also present in the composition a component (D) selected from the group consisting of (iv.1) tannic acids and (iv.2) water soluble and water dispersible polymers and copolymers of one or more x-(N—$R^1$—N—$R^2$-aminomethyl)-4-hydroxy-styrenes, where x=2, 4, 5, or 6, $R^1$ represents an alkyl group containing from 1 to 4 carbon atoms, and $R^2$ represents a substituent group conforming to the general formula $H(CHOH)_nCH_2$-, where n is an integer from 1 to 7; and (v) the pH of the composition is from about 1.6 to about 3.8.

5. A composition according to claim 4, wherein: (i) the concentration of component (A) is from about 2.0 to about 20 mM; (ii) component (B) is selected from acids with a hydroxyl group bonded to each carbon atom that does not form part of a carboxyl group and salts thereof; (iii) the ratio of the molar concentration of component (B) to the molar concentration of the element Ti in the composition is from about 0.15:1.0 to about 0.6:1.0; (iv) component (D) is selected from the group consisting of water soluble and water dispersible polymers and copolymers of one or more x-(N—$R^1$—N—$R^2$-aminomethyl)-4-hydroxy-styrenes, where x=2, 4, 5, or 6, $R^1$ represents an alkyl group containing from 1 to 4 carbon atoms, and $R^2$ represents a substituent group conforming to the general formula $H(CHOH)_nCH_2$-, where n is an integer from 1 to 7; (v) the concentration of component (D) is from about 150 to about 800 mg/L; (vi) the pH of the composition is from about 2.4 to about 3.5; and (vii) the total concentration of fluorine atoms in the composition is at least about 15 mM.

6. A composition according to claim 5, wherein: (i) the concentration of component (A) includes from about 4.0 to about 10 mM concentration of the total of $H_2TiF_6$ and $H_2ZrF_6$; (ii) component (B) is selected from acids with from four to eight carbon atoms; (iii) the ratio of the molar concentration of component (B) to the molar concentration of the element Ti in the composition is from about 0.26:1.0 to about 0.5:1.0; (iv) component (D) is selected from the group consisting of water soluble and water dispersible polymers and copolymers of one or more x-(N—$R^1$—N—$R^2$-aminomethyl)-4-hydroxy-styrenes, where x=2, 4, 5, or 6, $R^1$ represents an alkyl group containing from 1 to 4 carbon atoms, and $R^2$ represents a substituent group conforming to the general formula $H(CHOH)_nCH_2$-, where n is an integer from 1 to 7; (v) the concentration of component (D) is from about 300 to about 800 mg/L; (vi) the pH of the composition is from about 2.6 to about 3.3; and (vii) the total concentration of fluorine atoms in the composition is at least about 25 mM.

7. A composition according to claim 6, wherein: (i) the component (A) includes from about 5.8 to about 7.3 mM concentration of $H_2TiF_6$; (ii) component (B) is gluconic acid; (iii) the ratio of the molar concentration of component (B) to the molar concentration of the element Ti in the composition is from about 0.33:1.0 to about 0.39:1.0; (iv) component (D) is selected from the group consisting of water soluble and water dispersible polymers and copolymers of one or more x-(N—$R^1$—N—$R^2$-aminomethyl)-4-hydroxy-styrenes, where x=2, 4, 5, or 6, $R^1$ represents a methyl group, and $R^2$ represents a substituent group conforming to the general formula $H(CHOH)_nCH_2$-, where n is an integer from 3 to 5; (v) the concentration of component (D) is from about 450 to about 800 mg/L; (vi) the pH of the composition is from about 3.0 to about 3.1; and (vii) the total concentration of fluorine atoms in the composition is at least about 35 mM.

8. A process of treating a metal surface, said process comprising steps of:

(I) contacting a metal substrate selected from the group consisting of iron and steel, galvanized iron and steel, zinc and those of its alloys that contain at least 50 atomic percent zinc, and aluminum and its alloys that contain at least 50 atomic percent aluminum with a composition according to claim 7 for a time in the range from about 3 to about 30 seconds and at a temperature not greater than about 60° C.;

(II) rinsing the surface of the metal substrate contacted in step (I), before the surface dries or is dried, with water, and, optionally, also with an aqueous composition consisting essentially of water and a component selected from the group consisting of water soluble and water dispersible polymers and copolymers of one or more x-(N—$R^1$—N—$R^2$-aminomethyl)-4-hydroxystyrenes, where x=2, 4, 5, or 6, $R^1$ represents an alkyl group containing from 1 to 4 carbon atoms, and $R^2$ represents a substituent group conforming to the general formula $H(CHOH)_nCH_2$-, where n is an integer from 1 to 7; and (III) drying the rinsed metal surface from step (II); and, optionally, (IV) overcoating the dried surface from step (III) with a protective coating selected from the group consisting of vinyl, acrylic, epoxy and polyester based paints, enamels, and lacquers.

9. A process according to claim 8, where the treated metal substrate includes aluminum or an aluminum alloy containing at least 90% of aluminum.

10. An article of manufacture made by a process according to claim 9.

11. A process of treating a metal surface, said process comprising steps of:

(I) contacting a metal substrate selected from the group consisting of iron and steel, galvanized iron and steel, zinc and those of its alloys that contain at least 50 atomic percent zinc, and aluminum and its alloys that contain at least 50 atomic percent aluminum with a composition according to claim 6 for a time in the range from about 3 to about 30 seconds and at a temperature not greater than about 60° C.;

(II) rinsing the surface of the metal substrate contacted in step (I), before the surface dries or is dried, with water, and, optionally, also with an aqueous composition consisting essentially of water and a component selected from the group consisting of water soluble and water dispersible polymers and copolymers of one or more x-(N—$R^1$—N—$R^2$-aminomethyl)-4-hydroxystyrenes, where x=2, 4, 5, or 6, $R^1$ represents an alkyl group containing from 1 to 4 carbon atoms, and $R^2$ represents a substituent group conforming to the general formula $H(CHOH)_nCH_2$-, where n is an integer from 1 to 7; and (III) drying the rinsed metal surface from step (II); and, optionally, (IV) overcoating the dried surface from step (III) with a protective coating selected from the group consisting of vinyl, acrylic, epoxy and polyester based paints, enamels, and lacquers.

12. A process according to claim 11, where the treated metal substrate includes aluminum or an aluminum alloy containing at least 90% of aluminum.

13. An article of manufacture made by a process according to claim 9.

14. A process of treating a metal surface, said process comprising steps of:

(I) contacting a metal substrate selected from the group consisting of iron and steel, galvanized iron and steel, zinc and those of its alloys that contain at least 50 atomic percent zinc, and aluminum and its alloys that contain at least 50 atomic percent aluminum with a composition according to claim 5 for a time in the range from about 1 to about 300 seconds and at a temperature not greater than about 60° C.;

(II) rinsing the surface of the metal substrate contacted in step (I), before the surface dries or is dried, with water, and, optionally, also with an aqueous composition consisting essentially of water and a component selected from the group consisting of water soluble and water dispersible polymers and copolymers of one or more x-(N—$R^1$—N—$R^2$-aminomethyl)-4-hydroxystyrenes, where x=2, 4, 5, or 6, $R^1$ represents an alkyl group containing from 1 to 4 carbon atoms, and $R^2$ represents a substituent group conforming to the general formula $H(CHOH)_nCH_2$-, where n is an integer from 1 to 7; and (III) drying the rinsed metal surface from step (II); and, optionally, (IV) overcoating the dried surface from step (III) with a protective organic based coating.

15. A process according to claim 14, where the treated metal substrate includes aluminum or an aluminum alloy containing at least 90% of aluminum.

16. An article of manufacture made by a process according to claim 9.

17. A process of treating a metal surface, said process comprising steps of:

(I) contacting a metal substrate selected from the group consisting of iron and steel, galvanized iron and steel, zinc and those of its alloys that contain at least 50 atomic percent zinc, and aluminum and its alloys that contain at least 50 atomic percent aluminum with a composition according to claim 4 for a time in the range from about 1 to about 300 seconds and at a temperature not greater than about 60° C.;

(II) rinsing the surface of the metal substrate contacted in step (I), before the surface dries or is dried, with water, and, optionally, also with an aqueous composition consisting essentially of water and a component selected from the group consisting of water soluble and water dispersible polymers and copolymers of one or more x-(N—$R^1$—N—$R^2$-aminomethyl)-4-hydroxystyrenes, where x=2, 4, 5, or 6, $R^1$ represents an alkyl group containing from 1 to 4 carbon atoms, and $R^2$ represents a substituent group conforming to the general formula $H(CHOH)_nCH_2$-, where n is an integer from 1 to 7; and (III) dying the rinsed metal surface from step (II); and, optionally, (IV) overcoating the dried surface from step (III) with a protective coating selected from the group consisting of vinyl, acrylic, and polyester based paints, enamels, and lacquers.

18. A process according to claim 17, where the treated metal substrate includes aluminum or an aluminum alloy containing at least 90% of aluminum.

19. An article of manufacture made by a process according to claim 18.

20. An article of manufacture made by a process according to claim 17.

* * * * *